US012527455B2

(12) United States Patent
Zeng et al.

(10) Patent No.: US 12,527,455 B2
(45) Date of Patent: Jan. 20, 2026

(54) DISPENSING DEVICE FOR DISHWASHER, AND DISHWASHER

(71) Applicant: FOSHAN SHUNDE MIDEA WASHING APPLIANCES MANUFACTURING CO., LTD., Guangdong (CN)

(72) Inventors: Baoping Zeng, Guangdong (CN); Richao Liu, Guangdong (CN); Haoping Xiong, Guangdong (CN); Dapeng Shao, Guangdong (CN)

(73) Assignee: FOSHAN SHUNDE MIDEA WASHING APPLIANCES MANUFACTURING CO., LTD., Guangdon (CN)

( * ) Notice: Subject to any disclaimer, the term of this patent is extended or adjusted under 35 U.S.C. 154(b) by 178 days.

(21) Appl. No.: 18/070,913

(22) Filed: Nov. 29, 2022

(65) Prior Publication Data

US 2023/0090392 A1 Mar. 23, 2023

Related U.S. Application Data

(63) Continuation of application No. PCT/CN2022/070843, filed on Jan. 7, 2022.

(30) Foreign Application Priority Data

Jan. 8, 2021 (CN) ..... 202110023141.5
Jan. 8, 2021 (CN) ..... 202120052484.X
(Continued)

(51) Int. Cl.
*A47L 15/44* (2006.01)

(52) U.S. Cl.
CPC ..... *A47L 15/4418* (2013.01)

(58) Field of Classification Search
CPC . A47L 15/4418; A47K 5/1201; A47K 5/1204; A47K 5/1205
See application file for complete search history.

(56) References Cited

U.S. PATENT DOCUMENTS 3,198,387 A * 8/1965 Kendt ..... A47L 15/4418 68/17 R
7,931,032 B1 * 4/2011 Penkauskas ..... A47L 15/4463 134/94.1
(Continued)

FOREIGN PATENT DOCUMENTS

CN 105274790 A 1/2016
CN 205514267 U 8/2016
(Continued)

OTHER PUBLICATIONS

International Search Report dated Apr. 6, 2022 received in International Application No. PCT/CN2022/070843.
(Continued)

*Primary Examiner* — Spencer E. Bell
(74) *Attorney, Agent, or Firm* — Scully, Scott, Murphy & Presser, PC

(57) ABSTRACT

A dispensing device for a dishwasher and a dishwasher are provided. The dispensing device for the dishwasher has a liquid storage container, a pump body and a driving assembly. The liquid storage container stores liquid detergent. The pump body is mounted on the liquid storage container and has a pump head. The driving assembly operates to drive the pump head to pump the detergent in the liquid storage container into a washing chamber of the dishwasher.

18 Claims, 8 Drawing Sheets

(30) Foreign Application Priority Data

Jan. 8, 2021 (CN) ..... 202120052543.3
Jan. 8, 2021 (CN) ..... 202120052544.8

(56) References Cited

U.S. PATENT DOCUMENTS

| | | | | |
|---|---|---|---|---|
| 2015/0335224 | A1* | 11/2015 | Gursoy | A47L 15/449 134/99.2 |
| 2017/0027390 | A1* | 2/2017 | Maercovich | A47K 5/14 |
| 2022/0298709 | A1* | 9/2022 | Shafer | F04B 41/06 |

FOREIGN PATENT DOCUMENTS

| | | | | |
|---|---|---|---|---|
| CN | 206120180 | U | 4/2017 | |
| CN | 206204621 | U | 5/2017 | |
| CN | 108930143 | A | 12/2018 | |
| CN | 208808425 | U | 5/2019 | |
| CN | 110123239 | A | 8/2019 | |
| CN | 111172710 | A | 5/2020 | |
| CN | 211270604 | U | 8/2020 | |
| CN | 108930143 | B | 10/2020 | |
| CN | 216602803 | U | 5/2022 | |
| DE | 3812109 | A1 | 10/1989 | |
| FR | 1499690 | A | 10/1967 | |
| WO | 2014102369 | A1 | 7/2014 | |
| WO | WO-2018080545 | A1 * | 5/2018 | A47K 5/12 |

OTHER PUBLICATIONS

Extended European Search Report dated Oct. 19, 2023 received in European Patent Application No. EP 22736609.3.
Written Opinion dated Apr. 6, 2022 received in International Application No. PCT/CN2022/070843.
First Office Action dated May 17, 2025 received in Chinese Patent Application No. 202210015932.8.

* cited by examiner

DISPENSING DEVICE FOR DISHWASHER, AND DISHWASHER

CROSS-REFERENCE TO RELATED APPLICATIONS

The present application is a continuation application of PCT International Application No. PCT/CN2022/070843, filed on Jan. 7, 2022, which claims priority to Chinese Patent Applications Nos. 202110023141.5, 202120052484.X, 202120052544.8, and 202120052543.3, filed on Jan. 8, 2021 and entitled "DISPENSING DEVICE FOR DISHWASHER, AND DISHWASHER", the contents of each of which are incorporated herein by reference in their entirety for all purposes. No new matter has been introduced.

TECHNICAL FIELD

The present disclosure relates to the field of washing device technologies, and more specifically, to a dispensing device for a dishwasher, and a dishwasher.

BACKGROUND

In some related art, when dishwashers are used, liquid detergent is manually added into a washing chamber frequently, which may result in inconvenient using of the dishwashers. In some other related arts, for a dishwasher, a dispensing device is controlled by a motor to dispense the liquid detergent, and a dispensing volume of the liquid detergent is controlled based on operating time of the motor. Since a rotational speed of the motor is variable, the dispensing volume of the liquid detergent each time is inconstant. In some other related arts, a dispensing assembly of the dishwasher is less in number, which may allow a user to only make selection among limited types of detergent.

SUMMARY

The present disclosure aims to solve at least one of the technical problems in the related art. To this end, the present disclosure is to provide a dispensing device for a dishwasher. The dispensing device can realize automatic dispensing of liquid detergent, and it is not necessary for a user to manually add the liquid detergent and frequently dispense the liquid detergent. Therefore, the dishwasher is more conveniently used.

Another object of the present disclosure is to provide a dishwasher having the dispensing device.

According to an embodiment of the present disclosure, a dispensing device for a dishwasher includes a liquid storage container configured to store liquid detergent, a pump body mounted on the liquid storage container and having a pump head, and a driving assembly configured to drive the pump head to pump the liquid detergent in the liquid storage container into a washing chamber of the dishwasher.

With the dispensing device for the dishwasher according to embodiments of the present disclosure, the pump head is driven by the driving assembly to allow, for example, the pump head to move towards the liquid storage container to pump the liquid detergent in the liquid storage container into the washing chamber. Therefore, automatic dispensing of the liquid detergent can be realized. Further, it is not necessary for a user to manually add the liquid detergent and frequently dispense the liquid detergent. Therefore, the dishwasher is more conveniently used. Further, the pumped liquid detergent fully enters the washing chamber, which can avoid residue of the liquid detergent.

In addition, the dispensing device for the dishwasher according to the embodiments of the present disclosure has the following additional technical features.

In the dispensing device for the dishwasher according to some embodiments of the present disclosure, the driving assembly abuts against the pump head, and is adapted to drive the pump head to move towards the liquid storage container to pump the liquid detergent in the liquid storage container into the washing chamber of the dishwasher.

According to some embodiments of the present disclosure, the driving assembly includes a transmission member and a driving member. The driving member is connected to the transmission member, and adapted to drive the transmission member to move towards the liquid storage container along a first straight path to enable the transmission member to abut against the pump head and drive the pump head to move towards the liquid storage container.

According to some embodiments of the present disclosure, the driving member is further adapted to drive the transmission member to move away from the liquid storage container along the first straight path to reset the driving assembly; and/or the pump body further includes a reset member adapted to drive, in response to the transmission member moving away from the liquid storage container, the pump head to move away from the liquid storage container; and/or one of the pump head and an end of the transmission member has a limiting groove, and the other one of the pump head and the end of the transmission member has a limiting protrusion inserted into the limiting groove.

According to some embodiments of the present disclosure, the dispensing device for the dishwasher further includes a base having a guide channel extending along the first straight path. The transmission member moves with a guiding of the guide channel.

According to some embodiments of the present disclosure, the base further has a mounting chamber and a communication port configured to communicate the guide channel with the mounting chamber. The liquid storage container and the pump body are mounted in the mounting chamber, and the transmission member passes through the communication port.

According to some embodiments of the present disclosure, the dispensing device for the dishwasher further includes a seal configured to seal a gap between the transmission member and an inner peripheral surface of the communication port.

According to some embodiments of the present disclosure, the driving member includes a driving motor, and a connector connecting the transmission member with an output end of the driving motor. The driving motor is configured to drive the transmission member to move via the connector.

According to some embodiments of the present disclosure, the connector includes an eccentric wheel configured to be driven by the driving motor to rotate. The eccentric wheel has an engagement protrusion. The transmission member has an engagement groove. The engagement protrusion is movable along the engagement groove to convert the rotation of the eccentric wheel into the movement of the transmission member.

According to some embodiments of the present disclosure, the engagement groove extends along a second straight path. Every two of a rotation axis of the eccentric wheel, the first straight path, and the second straight path are perpendicular to one another.

According to some embodiments of the present disclosure, the transmission member is detachably fitted with the pump head.

According to some embodiments of the present disclosure, the pump head is configured to directly dispense the liquid detergent into the washing chamber.

According to some embodiments of the present disclosure, the pump head has a dispensing port configured to be in direct communication with the washing chamber.

According to some embodiments of the present disclosure, the dispensing device for the dishwasher further includes a base. The pump body is fixedly or detachably arranged on the base.

According to some embodiments of the present disclosure, the base has a mounting chamber, and a wall of the mounting chamber has a through opening. The pump head protrudes into the washing chamber of the dishwasher through the through opening to facilitate delivery of the liquid detergent in the liquid storage container to the washing chamber.

According to some embodiments of the present disclosure, the pump body and the liquid storage container are integrally formed, and are detachably mounted or fixedly arranged in the mounting chamber; or the liquid storage container is formed separately from the pump body and detachably mounted on the base. The liquid storage container is connected with the pump body when the liquid storage container is mounted on the base.

According to some embodiments of the present disclosure, the base includes a base body having the mounting chamber, and a cover body configured to expose or cover the opening. The mounting chamber having an opening.

According to some embodiments of the present disclosure, the pump body is fixedly or detachably connected to the liquid storage container.

According to some embodiments of the present disclosure, the dispensing device for the dishwasher further includes a dispensing volume detection mechanism configured to detect a volume of the pumped liquid detergent.

In the dispensing device for the dishwasher according to some embodiments of the present disclosure, the dispensing volume detection mechanism includes: a position detection assembly configured to detect a position of the pump head; and a control assembly connected to the position detection assembly and the driving assembly. The control assembly is configured to control an operating state of the driving assembly based on the detection from the position detection assembly.

According to some embodiments of the present disclosure, the control assembly is configured to count in response to detecting by the position detection assembly that the pump head reaches a first predetermined position, to determine a dispensing volume.

According to some embodiments of the present disclosure, the control assembly is further configured to control, in response to a count value reaching a predetermined threshold, the driving assembly to stop operating.

According to some embodiments of the present disclosure, the driving assembly includes a transmission member, and a driving member configured to drive the transmission member to move to drive the pump head to move. The position detection assembly is configured to detect a position of the transmission member and/or a position of the pump head to obtain the position of the pump head and determine the volume of the pumped liquid detergent.

According to some embodiments of the present disclosure, the position detection assembly includes a microswitch connected to the control assembly. The transmission member has a trigger protrusion, the trigger protrusion being configured to trigger the microswitch in response to the transmission member reaching a first predetermined position. The control assembly is further configured to count in response to the microswitch being triggered.

According to some embodiments of the present disclosure, the dispensing device for the dishwasher further includes a base having an accommodation cavity. The transmission member includes a transmission body, and the transmission body has one end fitted with the driving member and another end fitted with the pump head. The trigger protrusion is arranged on an outer peripheral surface of the transmission body and located in the accommodation cavity. The microswitch is mounted on the base and has a contact extending into the accommodation cavity. The trigger protrusion is adapted to be in contact with the contact to trigger the microswitch.

According to some embodiments of the present disclosure, the position detection assembly includes a reed switch connected to the control assembly, and a magnetic member disposed on the transmission member. The magnetic member is configured to drive, in response to the transmission member reaching a first predetermined position, the reed switch to be switched on. The control assembly is further configured to count in response to the reed switch being switched on.

According to some embodiments of the present disclosure, the position detection assembly includes a photoelectric sensor connected to the control assembly. The photoelectric sensor has an emitting end, and a receiving end configured to receive light emitted from the emitting end. The transmission member has a shielding portion configured to shield the light in response to the transmission member reaching a first predetermined position. The control assembly is further configured to count in response to the light being shielded.

According to some embodiments of the present disclosure, the position detection assembly includes a magnetic member disposed on the transmission member, and a Hall element connected to the control assembly. The Hall element is configured to, in response to the transmission member reaching a first predetermined position, detect the magnetic member and generate a pulse signal. The control assembly is further configured to count in response to the pulse signal being generated by the Hall element.

According to some embodiments of the present disclosure, the driving assembly includes a driving motor. The control assembly is further configured to cut off, in response to a count value reaching a predetermined threshold, a power of the driving motor.

According to some embodiments of the present disclosure, the pump head is movable between a first predetermined position and a second predetermined position. The pump head is configured to: move towards the liquid storage container when moving from the first predetermined position to the second predetermined position, to pump the liquid detergent in the liquid storage container into the washing chamber; and move away from the liquid storage container to be reset when moving from the second predetermined position to the first predetermined position.

According to some embodiments of the present disclosure, the pump body further includes a reset member configured to drive the pump head to move from the second predetermined position to the first predetermined position to be reset.

According to some embodiments of the present disclosure, the dispensing device for the dishwasher further includes a base, a liquid detergent dispensing assembly mounted on the base and configured to dispense the liquid detergent into the washing chamber of the dishwasher, a powder detergent dispensing assembly mounted on the base and configured to dispense a powder detergent into the washing chamber, and a rinse aid dispensing assembly mounted on the base and configured to dispense a rinse aid into the washing chamber.

In the dispensing device for the dishwasher according to some embodiments of the present disclosure, by arranging the liquid detergent dispensing assembly, the powder detergent dispensing assembly, and the rinse aid dispensing assembly, the user may select among the liquid detergent, the powder detergent, and the rinse aid to further satisfy more use demands of the user on the dishwasher, which has greater practicability.

In the dispensing device for the dishwasher according to some embodiments of the present disclosure, the base is a door body of the dishwasher or a wall of the washing chamber.

According to some embodiments of the present disclosure, the base is mounted on a door body of the dishwasher or a wall of the washing chamber.

According to some embodiments of the present disclosure, the base has a mounting chamber, a wall of the mounting chamber having a through opening. The liquid detergent dispensing assembly includes the liquid storage container mounted in the mounting chamber, and the pump head protruding into the washing chamber through the through opening to deliver the liquid detergent in the liquid storage container to the washing chamber.

According to some embodiments of the present disclosure, the base includes a base body having the mounting chamber, and a cover body configured to expose or cover the opening. The mounting chamber has an opening, and the through opening is defined in the cover body.

According to some embodiments of the present disclosure, the cover body is hinged to the base body.

According to some embodiments of the present disclosure, the base has an accommodation cavity. The liquid detergent dispensing assembly further includes the pump body and the driving assembly. The pump body is connected to the liquid storage container and has the pump head. The pump head is movable relative to the liquid storage container to pump the liquid detergent in the liquid storage container into the washing chamber. The driving assembly is mounted in the accommodation cavity and configured to drive the pump head to move.

According to some embodiments of the present disclosure, the liquid storage container is detachably mounted in the mounting chamber.

According to some embodiments of the present disclosure, the pump body is detachably connected to the liquid storage container. The driving assembly is detachably fitted with the pump head.

According to some embodiment of the present disclosure, a dishwasher includes the dispensing device for the dishwasher according to the embodiments of the present disclosure.

Additional aspects and advantages of the present disclosure will be provided at least in part in the following description, or will become apparent at least in part from the following description, or can be learned from practicing of the present disclosure.

BRIEF DESCRIPTION OF THE DRAWINGS

The above and/or additional aspects and advantages of the present disclosure will become more apparent and more understandable from the following description of embodiments taken in conjunction with the accompanying drawings, in which.

Figure 1:
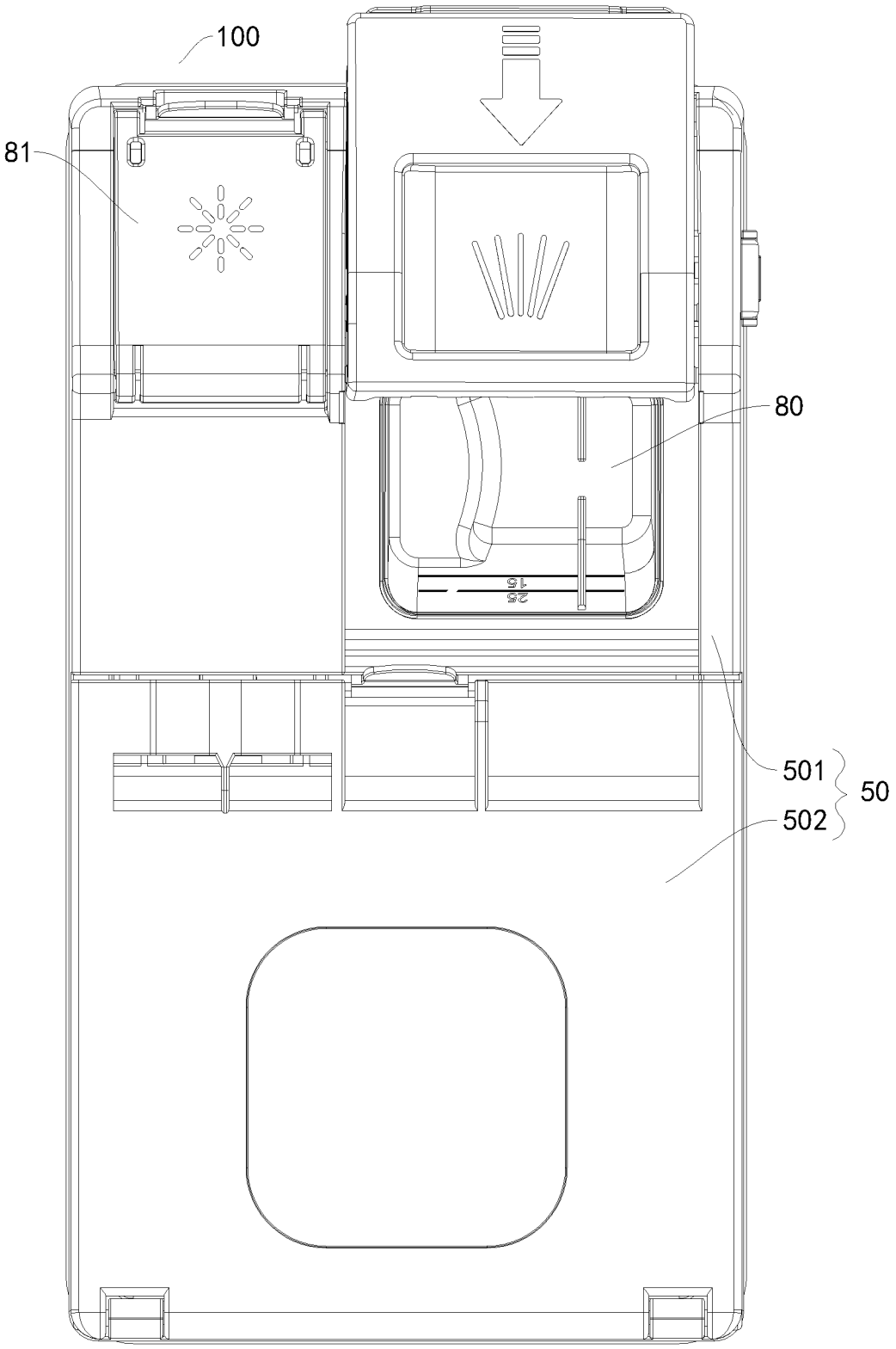
FIG. 1 is a schematic structural view of a dispensing device according to an embodiment of the present disclosure with a cover body closed.

REFERENCE NUMERALS dispensing device 100; liquid storage container 10; pump body 20; pump head 21; driving assembly 30; driving member 31; transmission member 32; driving motor 311; connector 312; engagement protrusion 313; engagement groove 321; trigger protrusion 322; limiting groove 40; limiting protrusion 41; base 50; guide channel 51; mounting chamber 52; communication port 53; accommodation cavity 54; base body 501; cover body 502; opening 521; through opening 522; contact 541; seal 60; position detection assembly 70; powder detergent dispensing assembly 80; rinse aid dispensing assembly 81.

DETAILED DESCRIPTION

Embodiments of the present disclosure will be described in detail below with reference to examples thereof as illustrated in the accompanying drawings, throughout which same or similar elements, or elements having same or similar functions, are denoted by same or similar reference numerals. The embodiments described below with reference to the drawings are illustrative only, and are intended to explain, rather than limiting, the present disclosure.

In the description of the present disclosure, it is to be understood that, terms such as "center", "longitudinal", "lateral", "length", "width", "thickness", "over", "below", "front", "back", "left", "right", "vertical", "horizontal", "top", "bottom", "in", "out", "clockwise", "counterclockwise", "axial", "radial", "circumferential", etc., is based on the orientation or position relationship shown in the drawings, and is only for the convenience of describing the present disclosure and simplifying the description, rather than indicating or implying that the associated device or element must have a specific orientation, or be constructed and operated in a specific orientation, and therefore cannot be understood as a limitation to the present disclosure.

In the description of the present disclosure, "the first feature" and "the second feature" may include at least one of the features, and "plurality" means at least two. The first feature being "on" or "under" the second feature may include the scenarios that the first feature is in direct contact with the second feature, or the first and second features, instead of being in direct contact with each other, are in contact with each other through another feature therebetween. The first feature being "above" the second feature may indicate that the first feature is directly above or obliquely above the second feature, or simply indicate that the level of the first feature is higher than that of the second feature.

A dispensing device 100 according to certain embodiments of the present disclosure will be described below with reference to the accompanying drawings.

Referring to FIG. 1 to FIG. 5 and FIG. 8, the dispensing device 100 according to the embodiments of the present disclosure may include a liquid storage container 10, a pump body 20, and a driving assembly 30.

In some embodiments, the liquid storage container 10 is configured to store liquid detergent therein. The pump body 20 is mounted in the liquid storage container 10, and has a pump head 21. The pump head 21 is movable relative to the liquid storage container 10 to pump the liquid detergent out of the liquid storage container 10 to realize dispensing of the liquid detergent. Therefore, the liquid detergent is pumped conveniently and quickly, and a volume of the pumped detergent every time is controllable.

Figure 2:
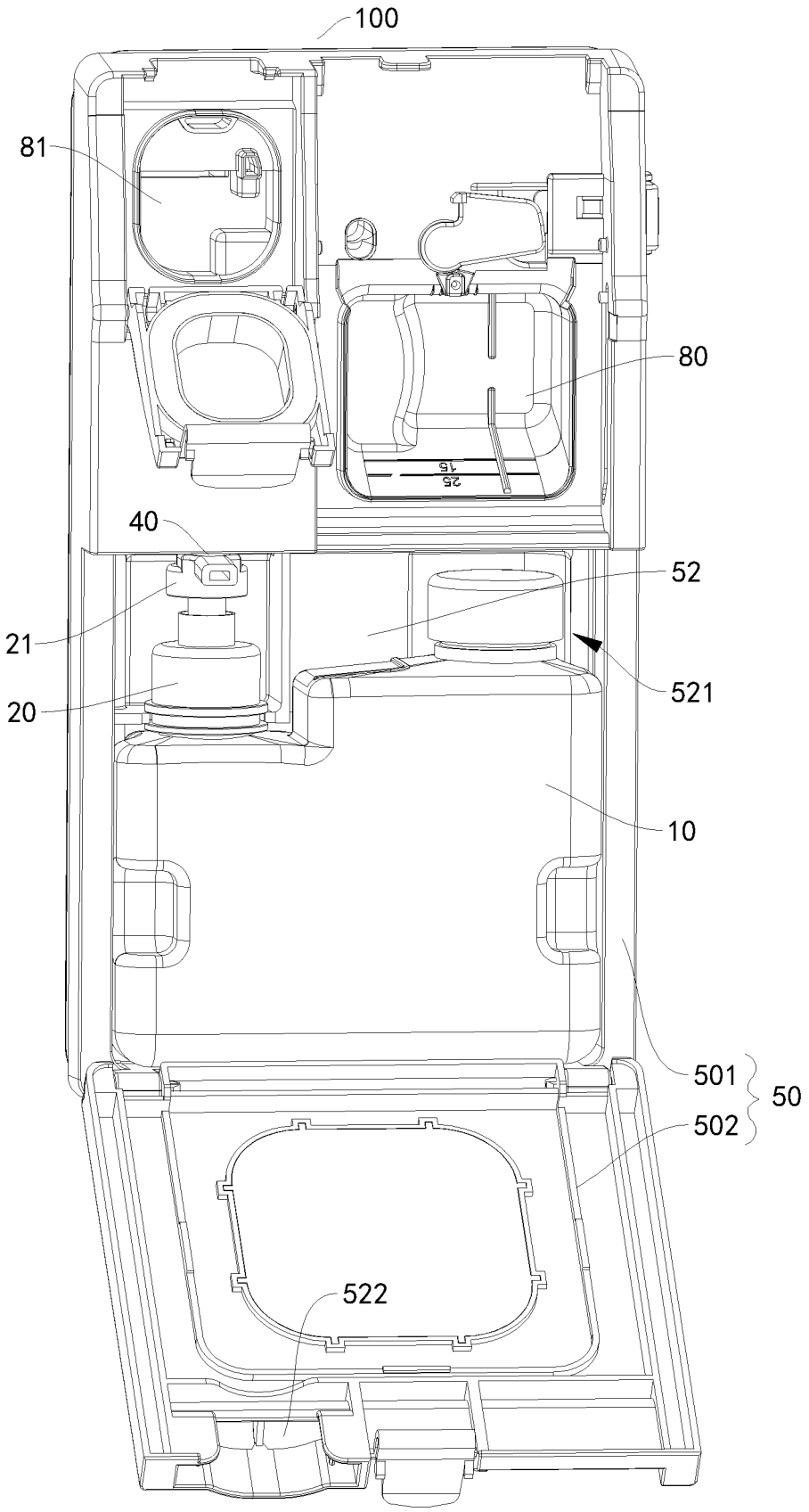
FIG. 2 is a schematic structural view of a dispensing device according to an embodiment of the present disclosure with a cover body opened.
Figure 3:
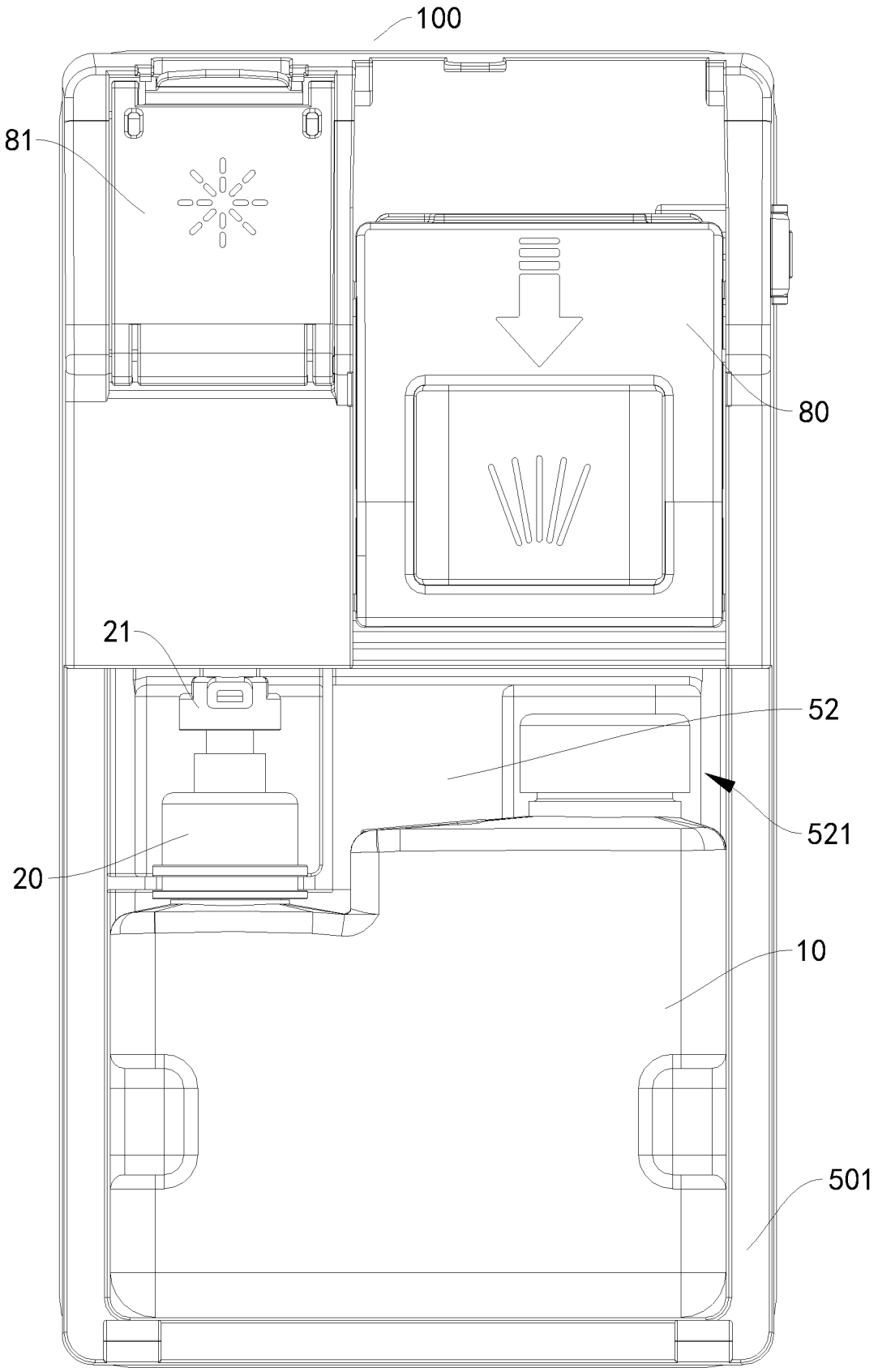
FIG. 3 is a schematic structural view of a dispensing device according to an embodiment of the present disclosure with a cover body not shown.
Figure 4:
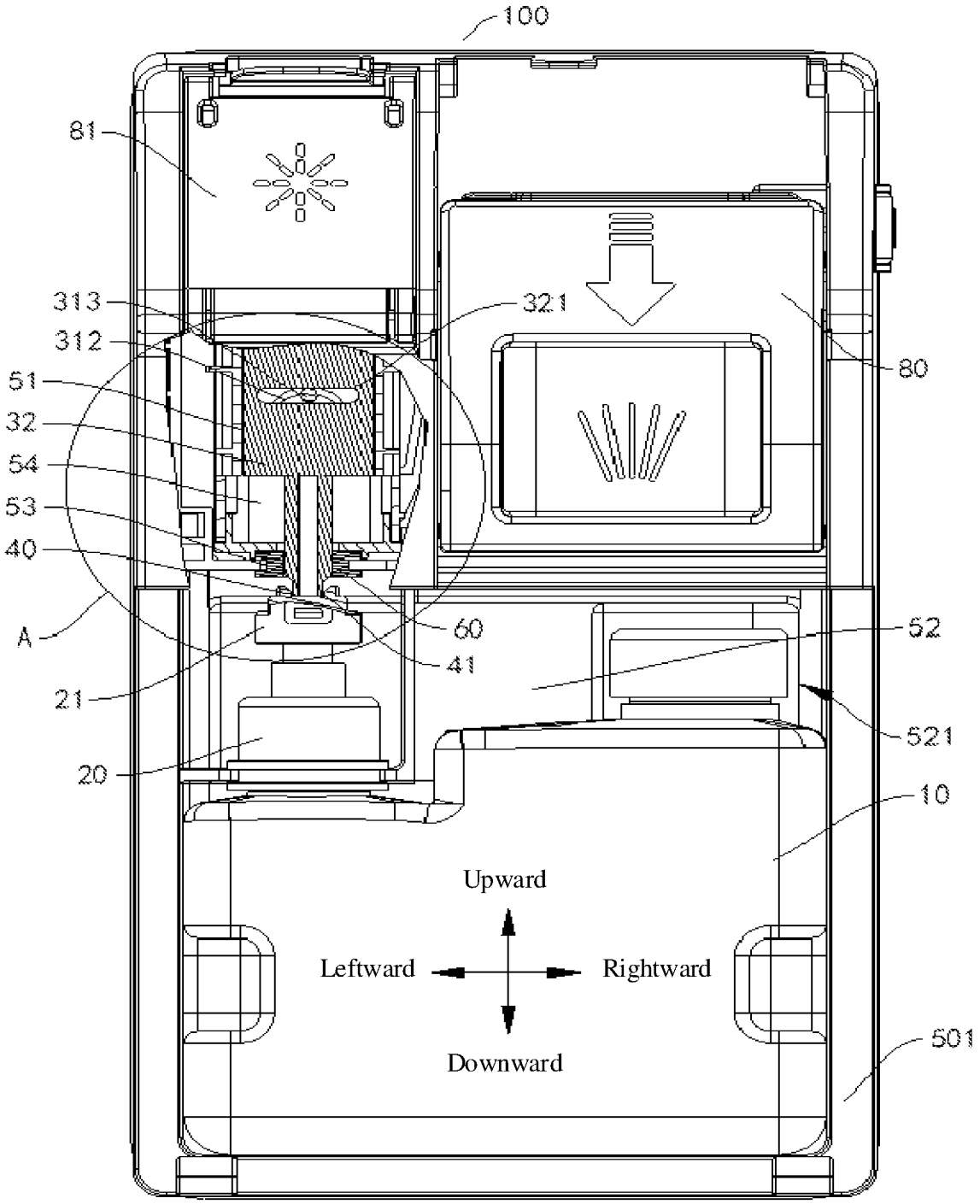
FIG. 4 is a partial cross-sectional view of a dispensing device according to an embodiment of the present disclosure.

In addition, as illustrated in FIG. 2 to FIG. 4, the driving assembly 30 is configured to drive the pump head 21 to pump the liquid detergent in the liquid storage container 10 into a washing chamber of a dishwasher. For example, the driving assembly 30 may abut against the pump head 21 and drive the pump head 21 to move towards the liquid storage container 10 to press the pump head 21 to pump the liquid detergent out of the liquid storage container 10, which enables the liquid detergent to be pumped into the washing chamber of the dishwasher. That is, when the pump head 21 moves towards the liquid storage container 10, the liquid detergent in the liquid storage container 10 can be pumped into the washing chamber of the dishwasher. Therefore, automatic dispensing of the liquid detergent can be realized. Further, it is not necessary for a user to manually dispense the liquid detergent into the washing chamber each time before washing tableware, which avoids the liquid detergent from being manually added and frequently dispensed by the user. Therefore, the dishwasher is more conveniently used. In addition, it is also possible to avoid washing effect of the tableware from being affected due to the liquid detergent being forgotten to be dispensed by the user.

In addition, during the driving of the pump head 21 by the driving assembly 30, the liquid detergent may be directly pumped into the washing chamber without flowing through other pipelines, which can avoid residue of the liquid detergent. Thus, it is possible to prevent the residual liquid detergent from being polluted and deteriorated, which is beneficial to improving sanitary condition of the dishwasher.

In some embodiments, as illustrated in FIG. 2 to FIG. 5, the driving assembly 30 may include a driving member 31, and a transmission member 32 connected to the driving member 31. The driving member 31 is configured to drive the transmission member 32 to move. The transmission member 32 is configured to cooperate with the pump head 21, to drive the pump head 21 to move in response to the transmission member 32 moving. For example, the transmission member 32 abuts against the pump head 21 and presses the pump head 21 to pump the liquid detergent out of the liquid storage container 10.

In some embodiments, with continued reference to FIG. 2 to FIG. 5, the driving member 31 is capable of driving the transmission member 32 to move towards the liquid storage container 10 along a first straight path (for example, move downwards in an upward-downward direction shown in FIG. 4), to allow the transmission member 32 to abut against the pump head 21. In this way, the pump head 21 is driven by the transmission member 32 to move towards the liquid storage container 10. Thus, the dispensing of the liquid detergent can be realized.

In a dispensing process of the liquid detergent, the liquid detergent in the liquid storage container 10 is directly pumped into the washing chamber through the pump head 21 without being in contact with the driving assembly 30, which effectively reduces a risk of leakage of the liquid detergent. Moreover, the transmission member 32 moves along the first straight path to drive the pump head 21 to move. The transmission resistance is thus relatively smaller. Thus, it is possible to avoid normal dispensing of the liquid detergent from being affected due to failure of the transmission member 32 or the pump head 21. In addition, the transmission member 32 abuts against the pump head 21, and when the pump body 20 or the driving assembly 30 is damaged, only the damaged component needs to be replaced, which effectively reduces maintenance costs. In some embodiments where the pump body 20 and the liquid storage container 10 are detachable, the transmission member 32 may be separated from the pump head 21, which makes disassembly and assembly easier.

It should be noted that the transmission member 32 may always abut against the pump head 21, or may abut against the pump head 21 after moving towards the liquid storage container 10 by a predetermined distance. For example, in some embodiments, when the transmission member 32 is in an initial position, the transmission member 32 is separated from the pump head 21, and may be driven by the driving member 31 to move downwards by the predetermined distance to abut against the pump head 21. Then, the transmission member 32 continues to move downwards to drive the pump head 21 to move downwards. In this way, the liquid detergent in the liquid storage container 10 is pumped into the washing chamber. Thus, the automatic dispensing of the liquid detergent can be realized.

It should be noted that, for ease of description, directions such as "upward-downward direction" and "leftward-rightward direction" in the present disclosure are based on an orientation relationship illustrated in the drawings, and are not limited to the orientation in an actual application.

With the dispensing device 100 according to the embodiments of the present disclosure, the pump head 21 is driven by the driving assembly 30. For example, the transmission member 32 is driven by the driving member 31 to move towards the liquid storage container 10 along the first straight path, the pump head 21 is then driven by the transmission member 32 to move towards the liquid storage container 10. In this way, the liquid detergent in the liquid storage container 10 is pumped into the washing chamber. Thus, the automatic dispensing of the liquid detergent can be realized. Further, it is not necessary for the user to manually add and frequently dispense the liquid detergent, which results in more convenient using of the dishwasher. In addition, the pumped liquid detergent can totally enter the washing chamber to avoid the residue of the liquid detergent, which is beneficial to improving the sanitary condition of the dishwasher. In addition, the transmission member 32 and the pump head 21 move smoothly, and are not prone to failure or resulting in leakage of the liquid detergent, which is convenient to disassemble and assemble, and facilitates reduction of maintenance costs.

According to some embodiments of the present disclosure, as illustrated in FIG. 4, the driving member 31 may further configured to drive the transmission member 32 to move away from the liquid storage container 10 along the first straight path. In this way, the transmission member 32 is reset to an initial position, and the driving assembly 30 is reset. Thus, the liquid detergent can be easily dispensed again.

In some embodiments of the present disclosure, the pump body 20 further includes a reset member (for example, a reset spring). When the driving assembly 30 is reset, i.e., when the driving assembly 30 is located at an initial position at which the pump head 21 is pressed by a minimum pressing force, for example, in an embodiment where the driving assembly 30 includes the transmission member 32, when the transmission member 32 moves away from the liquid storage container 10 to reset the driving assembly 30, the reset member can drive the pump head 21 to move away from the liquid storage container 10 to reset the pump head 21 to the initial position. Thus, it is possible for the driving assembly 30 to conveniently press the pump head 21 again. For example, it is possible for the pump head 21 to move towards the liquid storage container 10 again when the transmission member 32 moves towards the liquid storage container 10 along the first straight path again. The pump head 21 reciprocates to realize multi-dispensing of the liquid detergent. Thus, a dispensing volume of the liquid detergent can be ensured, and the dispensing is simple and quick.

For example, as illustrated in FIG. 4, the transmission member 32 may move upwards with the driving of the driving member 31 to remove a downward driving force on the pump head 21. In this way, the pump head 21 is driven by the reset member to move upwards, and the transmission member 32 and the pump head 21 are reset. When the transmission member 32 moves downwards again, the pump head 21 is driven by the transmission member 32 to move downwards to pump the liquid detergent in the liquid storage container 10 into the washing chamber. The above operations are repeated for several times to realize the multi-dispensing of the liquid detergent. Thus, the dispensing volume of the liquid detergent can be ensured.

The dishwasher may dispense the liquid detergent though controlling the dispensing device by a motor, and control the dispensing volume of the liquid detergent through controlling the motor to operate for a predetermined time. Since a rotational speed of the motor is variable, the dispensing volume of the liquid detergent within the predetermined time is inconstant during each dispensing.

For example, in some embodiments, the transmission member 32 may be movable between a first predetermined position and a second predetermined position. For example, in an example shown in FIG. 4, a level at which the transmission member 32 is located at the first predetermined position is higher than a level at which the transmission member 32 is located at the second predetermined position. When the transmission member 32 moves from the first predetermined position to the second predetermined position, the pump head 21 is driven to move towards the liquid storage container 10 to pump the liquid detergent in the liquid storage container 10 into the washing chamber. When the transmission member 32 moves from the second predetermined position to the first predetermined position, the pump head 21 moves away from the liquid storage container 10 to reset the pump head 21. Through the movement of the transmission member 32 in the upward-downward direction, the liquid detergent may be multi-pumped into the washing chamber. Thus, the dispensing volume of the liquid detergent can be ensured. Moreover, the transmission member 32 and the pump head 21 reciprocate by constant strokes, respectively, and thus the dispensing volume of the liquid detergent can be controlled by controlling the number of times of the reciprocation of the transmission member 32. Thus, the dispensing volume can be easily controlled.

According to some embodiments of the present disclosure, the liquid storage container 10 is replaceable, or the liquid detergent in the liquid storage container 10 may be added. Thus, long-term use of the dispensing device 100 can be ensured.

For example, in some embodiments, the transmission member 32 is detachably fitted with the pump head 21, which has good reliability, and facilitates access to the pump body 20 and the liquid storage container 10. Thus, it is possible to facilitate replacement of the pump body 20 and the liquid storage container 10 with a new pump body and a new liquid storage container to ensure that there is enough liquid detergent in the dispensing device 100 to be dispensed into the washing chamber. For example, the pump body 20 and the liquid storage container 10 may be replaced as a consumable material as a whole, and the replacement is convenient.

For another example, in some embodiments, the pump body 20 is detachably connected to the liquid storage container 10. When the volume of the liquid detergent is insufficient, the pump body 20 and the liquid storage container 10 may be removed by the user to add the liquid detergent into the liquid storage container 10, or the liquid storage container 10 may be replaced as the consumable material as a whole, which ensures that the liquid storage container 10 has sufficient liquid detergent. Thus, the operation is convenient, and cost is low.

Further, in some embodiments, the transmission member 32 is detachably fitted with the pump head 21, and the pump body 20 is detachably connected to the liquid storage container 10. Therefore, the user may select a manner of adding the liquid detergent as desired to satisfy different demands of the user.

In the embodiments of the present disclosure, a specific structure in which the transmission member 32 and the pump head 21 are detachably fitted with each other may be flexibly configured as desired. For example, the transmission member 32 and the pump head 21 may be fitted with each other via a snapping connection, a fastener connection, or the like.

Figure 5:
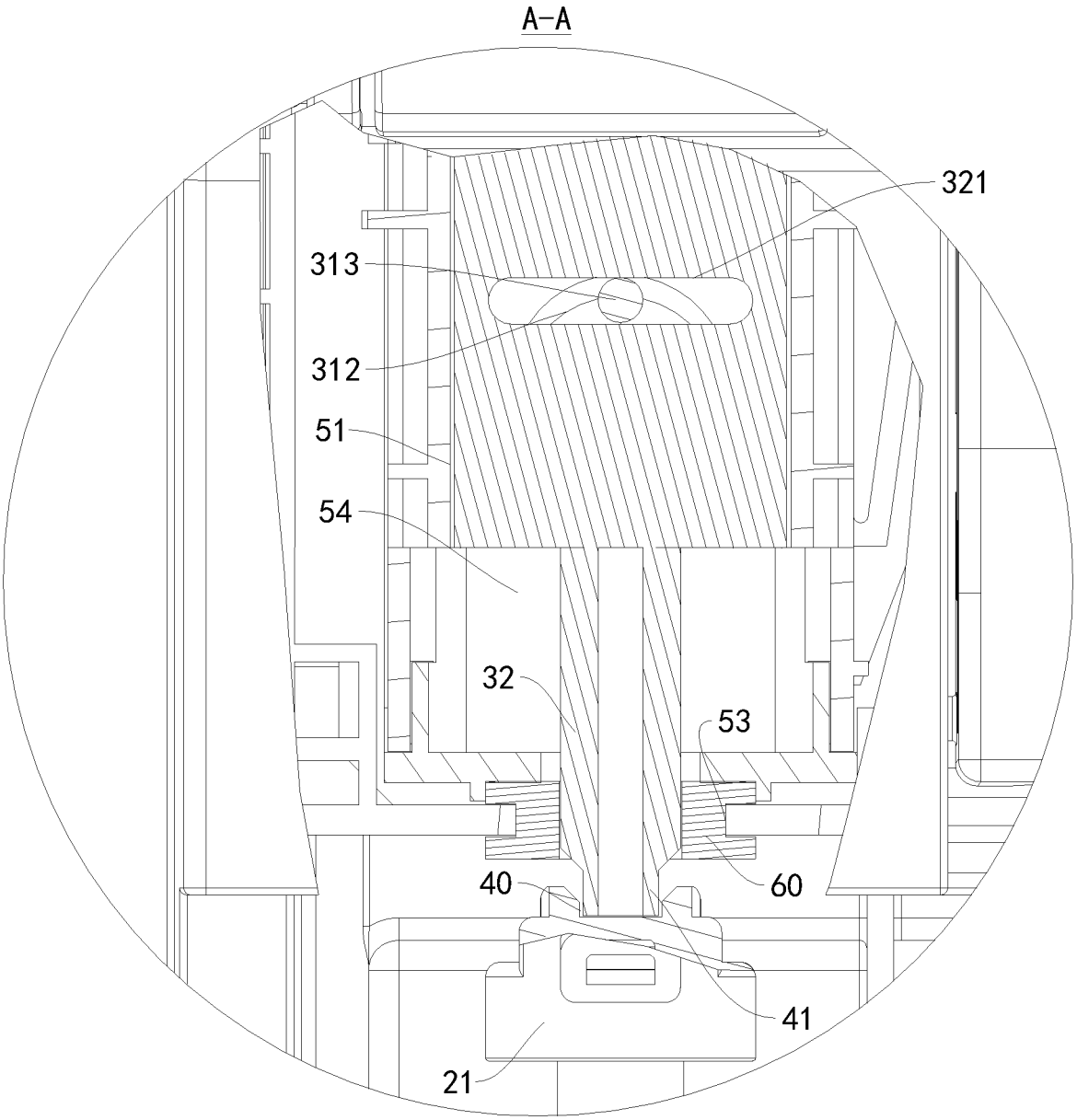
FIG. 5 is a schematic structural enlarged view of part A shown by a circle in FIG. 4.

For example, in some embodiments of the present disclosure, as illustrated in FIG. 3 to FIG. 5, the pump head 21 is provided with a limiting groove 40. An end of the transmission member 32 is provided with a limiting protrusion 41 inserted into the limiting groove 40. The limiting groove 40 is configured to limit the limiting protrusion 41. Thus, it is possible to ensure that the transmission member 32 can accurately exert a force on the pump head 21 without offset when moving downward. Thus, a reliable force can be applied to the pump head 21. Further, a lower end of the limiting protrusion 41 is in contact with a bottom surface of the limiting groove 40, which can ensure a reliable contact and a stable force, and thus has a better dispensing volume.

The limiting groove 40 may also be disposed in the transmission member 32. In some embodiments, the end of the transmission member 32 is provided with the limiting groove 40, and the pump head 21 is provided with the limiting protrusion 41 inserted into the limiting groove 40, which are also within the scope of the present disclosure.

According to some embodiments of the present disclosure, the pump head 21 is configured to directly dispense the liquid detergent into the washing chamber. That is, the liquid detergent pumped through the pump head 21 can enter the washing chamber without passing through other pipelines. Thus, it is possible to avoid the residue of the liquid detergent due to too long pipeline, which facilitates improving the sanitary condition of the dishwasher.

In some embodiments, the pump head 21 has a dispensing port. The dispensing port is configured to be in direct communicate with the washing chamber to allow the liquid detergent pumped through the pump head 21 via the dispensing port to be directly dropped into the washing chamber, which has a simple communication structure and can effectively avoid the residue of the liquid detergent.

According to some embodiments of the present disclosure, as illustrated in FIG. 1 to FIG. 5, the dispensing device 100 further includes a base 50. The pump body 20 may be fixedly disposed on the base 50 to stabilize a structure of the pump body 20, or the pump body 20 may be detachably disposed on the base 50 to facilitate maintenance and replacement of the pump body 20.

Here, the pump body 20 and the liquid storage container 10 may be formed separately or integrally formed. That is, the assembled pump body 20 and the liquid storage container 10 may be mounted on the base 50, or the pump body 20 and the liquid storage container 10 may be mounted on the base 50, respectively.

For example, the pump body 20 is mounted on the base 50. The pump body 20 and the base 50 may be fixedly or detachably connected to each other. When the liquid storage container 10 and the pump body 20 are formed separately, the liquid storage container 10 may be arranged to be detachably mounted on the base 50. Thus, the liquid storage container 10 can be removed to be fill with the liquid detergent. After the liquid storage container 10 is mounted on the base 50, the liquid storage container 10 may be connected to the pump body 20. Thus, the connection between the pump body 20 and the liquid storage container 10 can be realized, which facilitates the pumping of the liquid detergent. In the embodiment, the liquid storage container 10 may also be mounted on the base 50, and then the pump body 20 is mounted on the base 50. In addition, the liquid storage container 10 may also be configured to be non-detachably connected to the base 50, and adding and replacement of the liquid detergent may be done in other manners.

In addition, the pump body 20 and the liquid storage container 10 may also be assembled together to form an integrated structure, and then the assembled integrated structure is mounted on the base 50. The pump body 20 and the liquid storage container 10 may be detachably or non-detachably connected to each other.

In some embodiments of the present disclosure, the pump body 20 and the liquid storage container 10 may be integrated with each other. It should be noted that the pump body 20 and the liquid storage container 10 may be fixedly or detachably connected together to form the integrated structure, and the integrated structure may move together to facilitate the operation. This integrated structure may also reduce a mounting structure of a machine body, which makes the assembly simple, and thus production costs are reduced.

In some embodiments, the integrated structure may be detachably mounted on the machine body, for example, mounted in a mounting chamber, to facilitate the adding of the liquid detergent. For example, the integrated structure may be removed and then the liquid detergent is added, which makes the operation convenient. In some embodiments, the integrated structure may be fixedly disposed on the machine body, for example, fixedly disposed in the mounting chamber. Thus, the pump body 20 and the liquid storage container 10 are installed stably and not prone to being vibrated or damaged.

In some embodiments, with continued reference to FIG. 1 to FIG. 5, the base 50 has a guide channel 51 extending along the first straight path. At least a part of the transmission member 32 is located in the guide channel 51. Therefore, the transmission member 32 may move with a guiding of the guide channel 51 to ensure that the transmission member 32 moves along the first straight path. Thus, it is possible to ensure that the transmission member 32 is accurately fitted with the pump head 21 during the movement.

In some embodiments, the base 50 may be a door body of the dishwasher or a wall of the washing chamber. That is, the driving assembly 30 and the liquid storage container 10 are mounted on the door body of the dishwasher or the wall of the washing chamber, which is beneficial to reducing a number of components and parts and a weight of the dishwasher, thereby achieving lightweight of the dishwasher.

In some other embodiments, the base 50 may be mounted on the door body of the dishwasher or the wall of the washing chamber. In this way, it is possible to facilitate the disassembly and assembly of the dispensing device 100 and the adding of the liquid detergent.

In some embodiments, as illustrated in FIG. 4 and FIG. 5, the base 50 further has a mounting chamber 52 and a communication port 53. The liquid storage container 10 and the pump body 20 are mounted in the mounting chamber 52. Thus, the dispensing device 100 has a neat appearance, and it is also beneficial to preventing a fluid from entering the dispensing device 100. The communication port 53 is configured to communicate the guide channel 51 and the mounting chamber 52, and the transmission member 32 abut against the pump head 21 through the communication port 53 to allow the transmission member 32 to drive the pump head 21 to move.

In some embodiments in which the base 50 is included, as illustrated in FIG. 2, the base 50 has the mounting chamber 52. A wall of the mounting chamber 52 has a through opening 522. The pump head 21 may protrude into the washing chamber through the through opening 522. Therefore, it is beneficial to delivering the liquid detergent in the liquid storage container 10 to the washing chamber to realize the adding of the liquid detergent, which has a simple structure. Further, it is possible to prevent the fluid in the washing chamber from entering the mounting chamber 52 and causing fluid accumulation.

In some embodiments of the present disclosure, as illustrated in FIG. 4 and FIG. 5, the dispensing device 100 further includes a seal 60. The seal 60 is configured to seal a gap between the transmission member 32 and an inner peripheral surface of the communication port 53 to prevent dust, foreign material, washing water, and other substances from entering the guide channel 51 through the communication port 53. Thus, it is possible to prevent the fluid from entering the driving assembly 30 to damage the driving assembly 30, which can ensure normal operation of the driving assembly 30. Moreover, the seal 60 is capable of limiting the movement of the transmission member 32 to ensure that the transmission member 32 moves along the first straight path.

In some embodiments, as illustrated in FIG. 1 to FIG. 4, the base 50 includes a base body 501 and a cover body 502. The base body 501 has the mounting chamber 52. The mounting chamber 52 has an opening 521. The cover body 502 is configured to expose or cover the opening 521. The liquid storage container 10 is mounted in the mounting chamber 52 to ensure that the liquid storage container 10 is stably located in the mounting chamber 52, which avoids normal use of the dishwasher from being affected due to movement or separation of the liquid storage container 10, and facilitates the adding of the liquid detergent.

In some embodiments in which the pump body 20 and the liquid storage container 10 are detachably connected to each other, the opening 521 is exposed by the cover body 502, which is beneficial to taking, placing, disassembling and assembling the liquid storage container 10 to facilitate replacing the liquid storage container 10 with a new liquid storage container or adding the liquid detergent into the liquid storage container 10.

In some embodiments, as illustrated in FIG. 2, the cover body 502 may be hinged to the base body 501 to connect the cover body 502 to the base body 501, which has good connection effect. Further, the operation of exposing or covering the opening 521 by the cover body 502 is more convenient.

Figure 8:
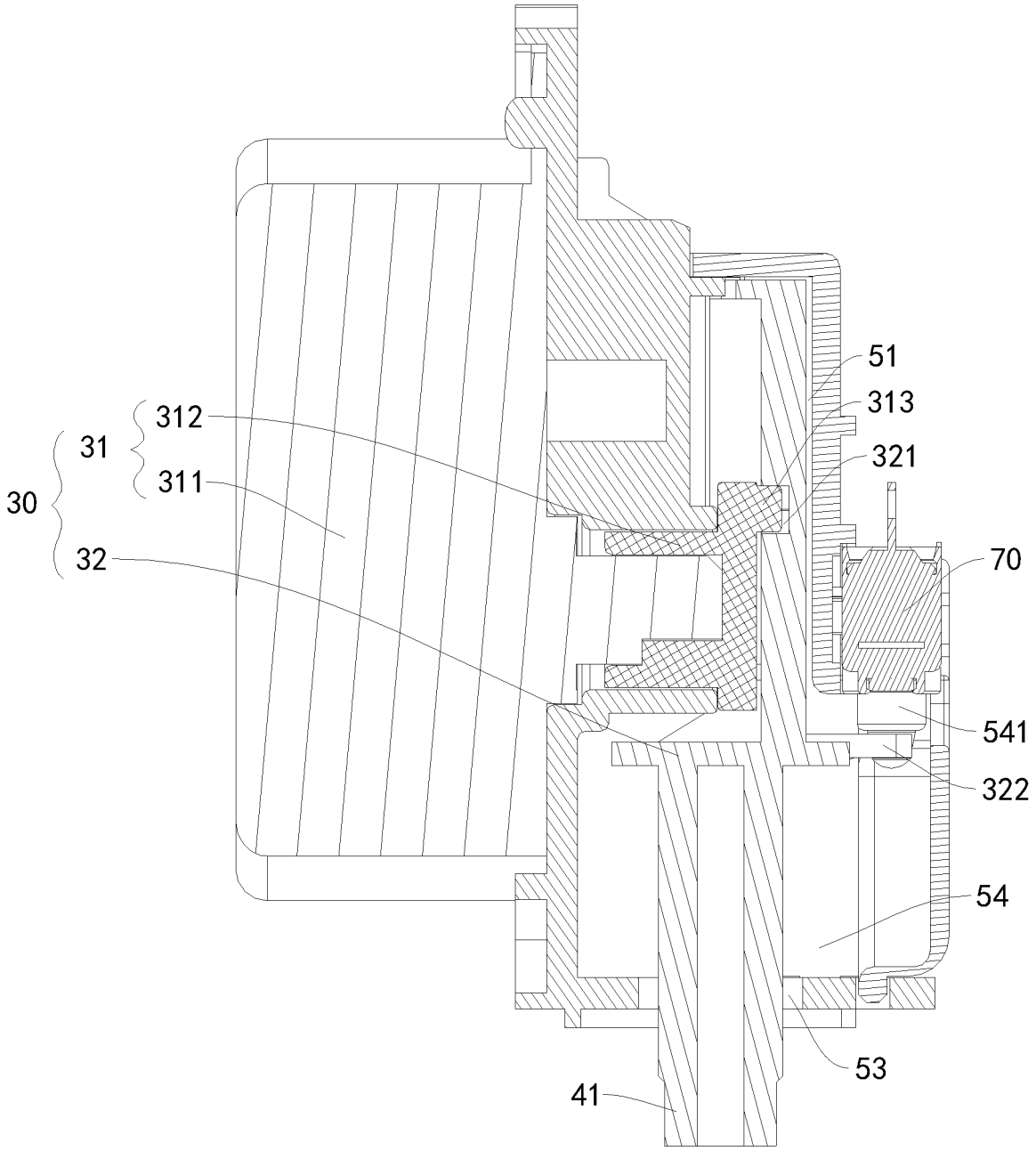
FIG. 8 is a cross-sectional view of a driving assembly and a position detection assembly according to an embodiment of the present disclosure.

In some embodiments of the present disclosure, as illustrated in FIG. 8, the driving member 31 includes a driving motor 311, and a connector 312 connected to an output end of the driving motor 311. The transmission member 32 is connected to the connector 312. Therefore, the driving motor 311 is capable of driving the connector 312 to move, and the transmission member 32 is driven to move by the connector 312.

For example, in some embodiments, as illustrated in FIG. 8, the connector 312 may be an eccentric wheel. The eccentric wheel rotates when driven by the driving motor 311. The eccentric wheel is provided with an engagement protrusion 313. The transmission member 32 is provided with an engagement groove 321. The engagement protrusion 313 is movable along the engagement groove 321 to convert the rotation of the eccentric wheel into the movement of the transmission member 32. The transmission member 32 may be driven to reciprocate through circular movement or swing of the eccentric wheel, which needs no other reset structures and has a simple structure. Further, a small occupied space is required, and production costs is reduced.

According to some embodiments of the present disclosure, as illustrated in FIG. 4 and FIG. 8, the engagement groove 321 extends along a second straight path (such as the leftward-rightward direction shown in FIG. 4), and every two of a rotation axis of the eccentric wheel, the first straight path, and the second straight path are perpendicular to one another, which maximizes space utilization and reduces the occupied space to reduce an occupying space of the dispensing device 100 in the dishwasher and improve a space of the washing chamber of the dishwasher.

Figure 6:
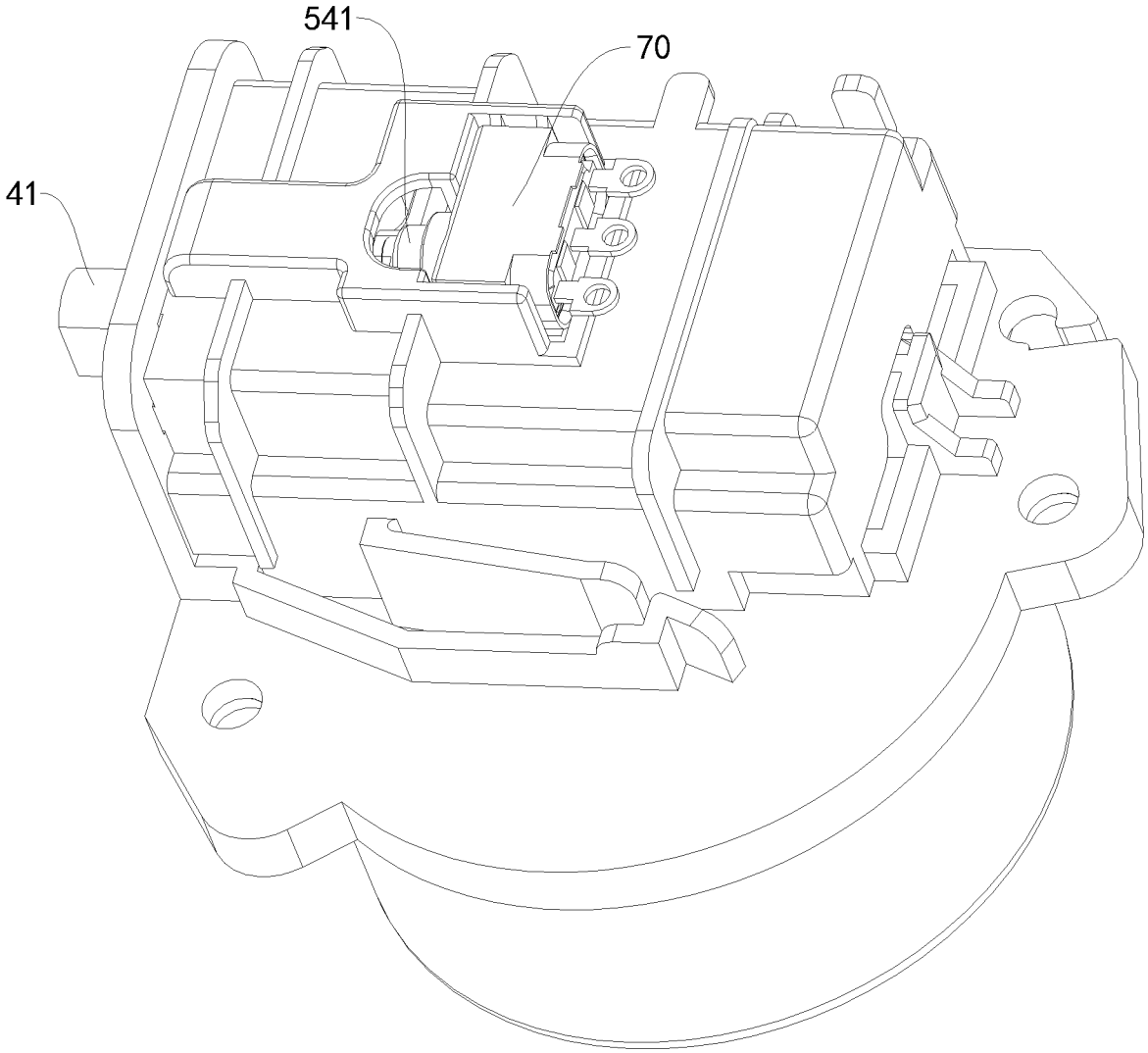
FIG. 6 is a schematic structural view of an angle between a driving assembly and a position detection assembly according to an embodiment of the present disclosure.
Figure 7:
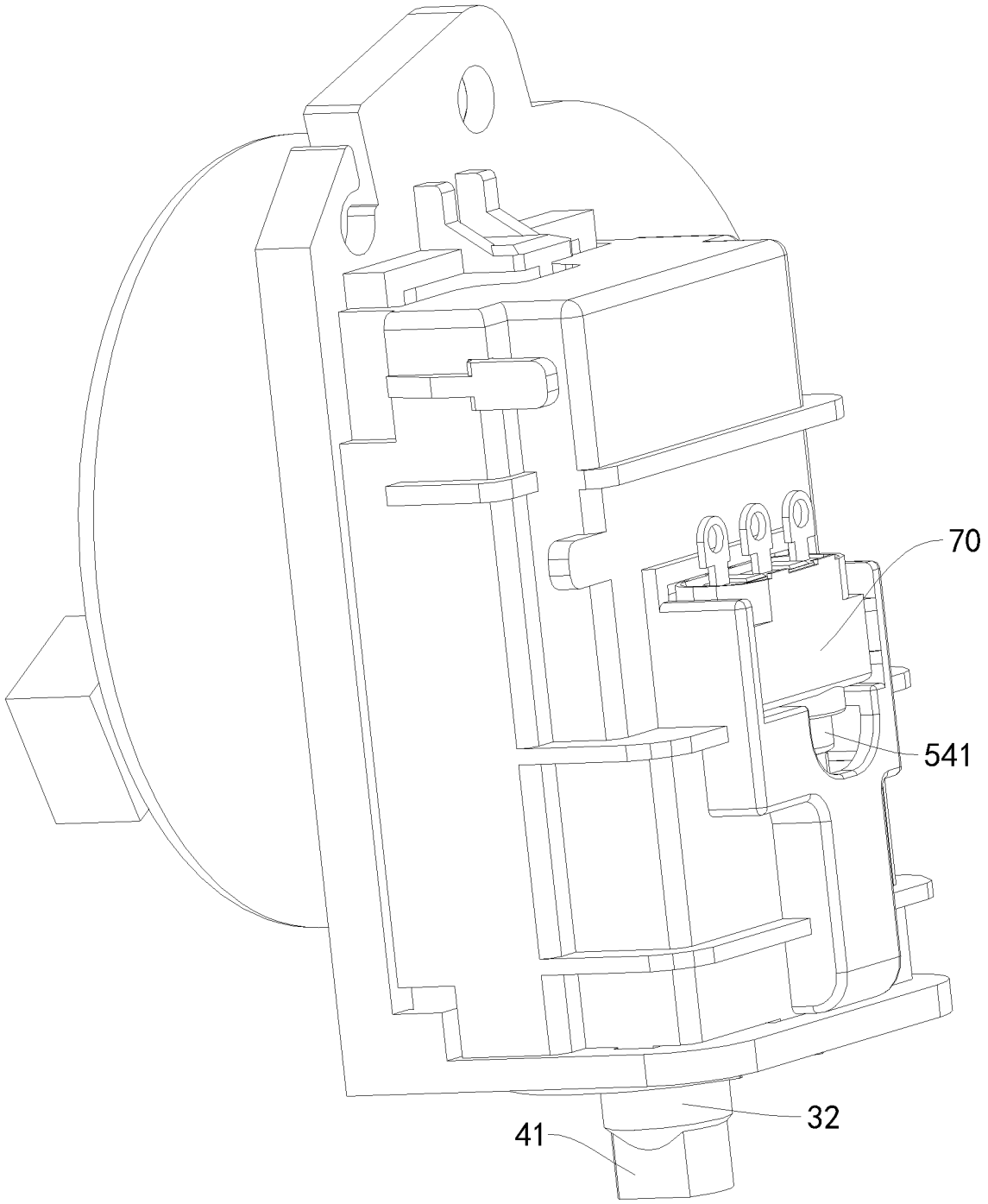
FIG. 7 is a schematic structural view of another angle between a driving assembly and a position detection assembly according to an embodiment of the present disclosure.

In some embodiments of the present disclosure, as illustrated in FIG. 6 to FIG. 8, the dispensing device 100 further includes a dispensing volume detection mechanism. The dispensing volume detection mechanism is configured to detect a volume of the liquid detergent pumped through the pump head 21 to achieve detection for the dispensing volume of the liquid detergent. Therefore, the liquid detergent is automatically dispensed more accurately, and it is possible to avoid unclean washing due to insufficient liquid detergent, excessive rinsing due to excessive liquid detergent, or the like.

In some embodiments of the present disclosure, the pump head 21 is configured to reciprocate between a first predetermined position and a second predetermined position to dispense the liquid detergent. The dispensing volume detection mechanism can detect the number of times of the reciprocation of the pump head 21 to obtain an volume of pumped liquid detergent. Thus, the control on the dispensing volume of the liquid detergent is more accurate.

The dispensing volume is detected based on the number of times of the reciprocation of the pump head 21, rather than controlling the dispensing volume of the liquid detergent based on a time of the reciprocation of the pump head 21. Therefore, the dispensing volume of the liquid detergent would not be affected by factors such as a speed of the reciprocation of the pump head 21, and can be controlled more accurately when the tableware is washed. Thus, the control is convenient.

In addition, the dispensing volume detection mechanism is further configured to detect whether the pump head 21 is reset. Thus, it is possible to prevent the normal dispensing of the liquid detergent from being affected due to failure of the pump head 21.

In some embodiments, as illustrated in FIG. 6 to FIG. 8, the dispensing volume detection mechanism includes a position detection assembly 70 configured to detect a position of the pump head 21.

In this way, the number of times, a displacement, and the like of the reciprocation of the pump head 21 can be determined based on the detection from the position detection assembly 70, and the dispensing volume of the liquid detergent is further determined. Thus. The control on the dispensing volume of the liquid detergent is more accurate. The dispensing volume is detected based on the position of the pump head 21, rather than controlling the dispensing volume of the liquid detergent based on an operation time of the pump head 21. Therefore, the dispensing volume of the liquid detergent would not be affected by factors such as the speed of the reciprocation of the pump head 21, and can be controlled more accurately when the tableware is washed. Thus, the control is convenient.

In addition, the position detection assembly 70 is further configured to detect conditions such as a driving condition in which the pump head 21 is driven by the driving assembly 30 to move, whether the pump head 21 is reset. Thus, it is possible to prevent the normal dispensing of the liquid detergent from being affected due to the failure of the driving assembly 30 or the pump head 21.

In some embodiments, the dispensing volume detection mechanism further includes a control assembly. The control assembly is connected to the position detection assembly 70 and the driving assembly 30. The control assembly is configured to control an operation state of the driving assembly 30 based on the detection from the position detection assembly 70. For example, in response to determining that the dispensing volume of the liquid detergent reaches a desired volume based on the position detection, the driving assembly 30 is controlled to stop operating; or in response to determining that the driving assembly 30 or the pump head 21 is failed based on the position detection, the driving assembly 30 is controlled to stop operating. In this case, the dispensing device 100 may be further controlled to send a fault indication information to indicate the user to perform maintenance.

In some embodiments, in response to detecting by the position detection assembly 70 that the pump head 21 reaches the first predetermined position, the control assembly counts to determine the dispensing volume. In this way, it is possible to ensure constant and accurate dispensing volume of the liquid detergent in a single reciprocation of the pump head 21.

In addition, in response to a count value reaching a predetermined threshold, the driving assembly 30 is controlled to stop operating by the control assembly. The pump head 21 reaching the first predetermined position each time indicates that one complete dispensing is completed, and the dispensing volume of each complete dispensing is constant. By controlling the number of times of the reciprocation of the pump head 21, a number of times of quantitative dispensing of the liquid detergent is controlled to accurately control the dispensing volume of the liquid detergent in each washing process. Thus, it is possible to ensure dispensing precision of the liquid detergent, which in turn ensures cleaning performance of the dishwasher.

In some embodiments in which the driving assembly 30 includes the driving motor 311, in response to the count value reaching the predetermined threshold, the control assembly cuts off a power of the driving motor 311. In this way, the dispensing of the liquid detergent is stopped, and energy loss can be reduced. Thus, electricity is saved, which facilitates low energy consumption of the dishwasher.

In addition, in the embodiment where the transmission member 32 has the first predetermined position and the second predetermined position, the control assembly can control the transmission member 32 to be positioned in the first predetermined position. That is, the transmission member 32 is reset to the initial position, which facilitates the user to mount or detach the liquid storage container 10.

In some embodiments, the predetermined threshold is greater than or equal to 1, and a specific value may be set based on actual conditions such as tableware washing effect. For example, the predetermined threshold may be set before leaving the factory or set by the user. In some embodiments, the predetermined threshold may be 1, 2, 3, 4, 5, or the like.

In the embodiment in which the driving assembly 30 includes the driving member 31 and the transmission member 32, the position detection assembly 70 is further configured to detect a position of the transmission member 32. In some embodiments, the control assembly is configured to count in response to detecting by the position detection assembly 70 that the transmission member 32 reaches the first predetermined position, and control the driving member 31 to stop operating in response to the count value reaching the predetermined threshold, which is also within the scope of the present disclosure.

In some embodiments of the present disclosure, the pump head 21 is movable between the first predetermined position and the second predetermined position. The pump head 21 is configured to: pump the liquid detergent in the liquid storage container 10 out of the liquid storage container 10 to dispense the liquid detergent when moving from the first predetermined position to the second predetermined position. Further, when the pump head 21 moves from the second predetermined position to the first predetermined position, the pump head 21 moves away from the liquid storage container 10 to be reset.

In some embodiments, the pump body 20 may further include a reset member. The reset member is configured to drive the pump head 21 to move from the second predetermined position to the first predetermined position to be reset. In this way, it is possible to ensure that the pump head 21 can smoothly reciprocate. Further, it is also possible to ensure that the pump head 21 can be accurately reset to the first predetermined position each time, which facilitates accurate controlling the dispensing volume of the liquid detergent.

It should be noted that the position detection assembly may directly or indirectly detect the position of the pump head 21, which can both determine the dispensing volume of the liquid detergent, and also have a beneficial effect such as accurate dispensing volume control.

In some embodiments of the present disclosure, as illustrated in FIG. 6 to FIG. 8, the driving assembly 30 includes the transmission member 32 and the driving member 31. The transmission member 32 is configured to drive the pump head 21 to move, and the driving member 31 is configured to drive the transmission member 32 to move to allow the transmission member 32 to drive the pump head 21 to move. The position detection assembly is configured to detect a position of at least one of the transmission member 32 and the pump head 21 to obtain the position of the pump head 21 and determine an volume of the pumped liquid detergent. In this way, it is possible to ensure position detection accuracy of the pump head 21 and detection accuracy of the dispensing volume of the liquid detergent.

In some embodiments of the present disclosure, the position detection assembly 70 includes at least one of a microswitch, a Hall element, a reed switch, and a photoelectric sensor, which all can detect the position of the transmission member 32 and have a small size, a light weight, and sensitive detection.

For example, in a first embodiment, as illustrated in FIG. 6 to FIG. 8, the position detection assembly 70 may include the microswitch connected to the control assembly. The transmission member 32 has a trigger protrusion 322. In response to the transmission member 32 moving to the first predetermined position, the microswitch is triggered by the trigger protrusion 322, and the control assembly counts in response to the microswitch being triggered. Therefore, a number of times the transmission member 32 moves to the first predetermined position can be obtained based on a number of times the microswitch is triggered by the trigger protrusion 322. Thus, it is possible to obtain the number of times of the reciprocation of the transmission member 32 to control the dispensing volume of the liquid detergent, which has a simple structure and good control effect.

In some embodiments, as illustrated in FIG. 6 to FIG. 8, the base 50 has an accommodation cavity 54 for accommodating the transmission member 32. The transmission member 32 is mounted in the accommodation cavity 54. The transmission member 32 includes a transmission body. One end of the transmission body is fitted with the driving member 31, for example, through the engagement groove 321 and the engagement protrusion 313. Another end of the transmission body is fitted with the pump head 21, for example, through the limiting groove 40 and the limiting protrusion 41. The trigger protrusion 322 is disposed on an outer peripheral surface of the transmission body and is located in the accommodation cavity 54. The microswitch is mounted on the base 50 and has a contact 541. The contact 541 extends into the accommodation cavity 54 to bring the trigger protrusion 322 into contact with the contact 541 to trigger the microswitch. In this way, the position of the driving member 31 can be detected.

For example, in a second embodiment, the position detection assembly 70 may include the reed switch connected to the control assembly, and a magnetic member disposed on the transmission member 32. In response to the transmission member 32 reaching the first predetermined position, the reed switch is driven by the magnetic member to be switched on. In response to the transmission member 32 moving away from the first predetermined position, the reed switch is switched off, and the control assembly counts in response to the reed switch being switched on. Therefore, the number of times the transmission member 32 reaches the first predetermined position can be obtained based on a number of times the reed switch is switched on to obtain the number of times of the reciprocation of the transmission member 32. In this way, the dispensing volume of the liquid detergent can be controlled, which has a simple structure and good control effect.

For example, 2in a third embodiment, the position detection assembly 70 may include the photoelectric sensor connected to the control assembly. The photoelectric sensor has an emitting end and a receiving end. The receiving end is configured to receive light emitted from the emitting end. The transmission member has a shielding portion. The shielding portion is capable of shielding the light in response to the transmission member 32 reaching the first predetermined position. In response to the transmission member 32 moving away from the first predetermined position, the receiving end can receive the light emitted from the emitting end again, and the control assembly counts in response to the light being shielded. Therefore, the number of times the transmission member 32 reaches the first predetermined position can be obtained based on the number of times the receiving end is shielded. Thus, it is possible to obtain the number of times of the reciprocation of the transmission member 32. In this way, the dispensing volume of the liquid detergent is controlled, which has a simple structure and good control effect.

For example, in a fourth embodiment, the position detection assembly 70 may include the Hall element connected to the control assembly and the magnetic member disposed on the transmission member 32. In response to the transmission member 32 reaching the first predetermined position, the magnetic member can be detected by the Hall element, and a pulse signal is generated by the Hall element. When the transmission member 32 moving away from the first predetermined position, the magnetic member cannot be detected by the Hall element, and the control assembly counts in response to the pulse signal being generated by the Hall element. Therefore, the number of times the transmission member 32 reaches the first predetermined position can be obtained based on the number of times the pulse signal is generated by the Hall element. Thus, it is possible to obtain the number of times of the reciprocation of the transmission member 32. In this way, the dispensing volume of the liquid detergent can be controlled, which has a simple structure and good control effect.

In some embodiments in which the driving member 31 includes the driving motor 311, in response to the count value reaching the predetermined threshold, the control assembly cuts off the power of the driving motor 311. In this way, the dispensing of the liquid detergent is stopped, and energy loss can be reduced. Thus, electricity is saved, which contributes to low energy consumption of the dishwasher.

In some embodiments, as illustrated in FIG. 1 to FIG. 4, the dispensing device 100 further includes a powder liquid detergent dispensing assembly 80. The powder liquid detergent dispensing assembly 80 is configured to dispense a powder liquid detergent into the washing chamber. When the tableware is washed, the user may select whether the liquid detergent is dispensed by the dispensing device 100 or the powder liquid detergent is dispensed by the powder liquid detergent dispensing assembly 80 as desired. Thus, more options are provided for the user, and the dishwasher can satisfy more demands of the user.

In some embodiments of the present disclosure, as illustrated in FIG. 1 to FIG. 4, the dispensing device 100 may include the base 50 and a dispenser. The dispenser is mounted on the base 50, and is configured to dispense a plurality of washing articles. It should be noted that the dispenser may be an integrated or separate member.

In some embodiments, as illustrated in FIG. 1 to FIG. 4, the dispenser is configured to dispense the liquid detergent and the powder liquid detergent. For example, the dispenser may include the liquid detergent dispensing assembly and the powder liquid detergent dispensing assembly 80. The liquid detergent dispensing assembly is configured to dispense the liquid detergent. The powder detergent dispensing assembly 80 is configured to dispense the powder detergent into the washing chamber. For example, the liquid detergent dispensing assembly may include the liquid storage container 10, the pump body 20, and the driving assembly 30.

When the tableware is washed, the user may make the selection whether the liquid detergent is dispended by the dispensing device 100, or the powder detergent is dispended by the powder detergent dispensing assembly 80, as desired. Thus, more selections are provided for the user, and the dishwasher can satisfy more use demands of the user.

In some embodiments, as illustrated in FIG. 1 to FIG. 4, the dispenser may be configured to dispense a rinse aid. For example, the dispenser may include the liquid detergent dispensing assembly and a rinse aid dispensing assembly 81. The rinse aid dispensing assembly 81 is configured to dispense the rinse aid into the washing chamber to brighten and maintain the washed tableware and remove residues such as water drops and dust spots.

In some embodiments, as illustrated in FIG. 1 to FIG. 4, the dispenser is configured to dispense the liquid detergent, the powder detergent, and the rinse aid. For example, the dispenser may include the liquid detergent dispensing assembly, the powder detergent dispensing assembly 80, and the rinse aid dispensing assembly 81 simultaneously. The user may select among the liquid detergent, the powder detergent, and the rinse aid to further satisfy more use demands of the user on the dishwasher, which has greater practicability.

Referring to FIG. 1 to FIG. 5, the dispensing device 100 according to the embodiments of the present disclosure may include the base 50, the liquid detergent dispensing assembly, the powder detergent dispensing assembly 80, and the rinse aid dispensing assembly 81.

In some embodiments, the liquid detergent dispensing assembly, the powder detergent dispensing assembly 80, and the rinse aid dispensing assembly 81 are mounted on the base 50, respectively. The liquid detergent dispensing assembly is configured to dispense the liquid detergent into the washing chamber of the dishwasher. The powder detergent dispensing assembly 80 is configured to dispense the powder detergent into the washing chamber. When washing the tableware, the user may make the selection whether the liquid detergent is dispensed through the liquid detergent dispensing assembly, or the powder detergent is dispensed through the powder detergent dispensing assembly 80, as desired. Thus, more selections are provided for the user, and the dishwasher can satisfy more use demands of the user. In addition, the rinse aid dispensing assembly 81 is configured to dispense the rinse aid into the washing chamber to brighten and maintain the washed tableware and remove residues such as water drops and dust spots. The user may select among the liquid detergent, the powder detergent, and the rinse aid to further satisfy more use demands on the dishwasher, which has greater practicability.

With the dispensing device 100 according to certain embodiments of the present disclosure, by providing the liquid detergent dispensing assembly, the powder detergent dispensing assembly 80, and the rinse aid dispensing assembly 81, the user may select among the liquid detergent, the powder detergent, and the rinse aid to further satisfy more use demands of the user on the dishwasher, which has greater practicability.

In some embodiments, the base 50 may be the door body of the dishwasher or the wall of the washing chamber. That is, the liquid detergent dispensing assembly, the powder detergent dispensing assembly 80, and the rinse aid dispensing assembly 81 may be mounted on the door body of the dishwasher or on the wall of the washing chamber, which is beneficial to reducing a number of components and parts and the weight of the dishwasher, and realizing the lightweight of the dishwasher.

In some other embodiments, the base 50 may be mounted on the door body of the dishwasher or on the wall of the washing chamber, which is beneficial to the assembly or disassembly of the dispensing device 100 and the adding of the liquid detergent, the powder detergent, and the rinse aid.

According to some embodiments of the present disclosure, as illustrated in FIG. 4 and FIG. 5, the base 50 has the mounting chamber 52. The liquid detergent dispensing assembly includes the liquid storage container 10 and the pump body 20. The liquid storage container 10 is configured to store the liquid detergent therein, and is mounted in the mounting chamber 52. Thus, the dispensing device 100 has a neat appearance. Further, it is beneficial to preventing the fluid from entering the dispensing device 100.

In some embodiments, as illustrated in FIG. 1 to FIG. 4, the base 50 includes the base body 501 and the cover body 502. The base body 501 has the mounting chamber 52. The mounting chamber 52 has the opening 521. The cover body 502 is configured to expose or cover the opening 521 to ensure that the liquid detergent dispensing assembly is fixedly mounted in the mounting chamber 52. In this way, it is possible to prevent the normal use of the dishwasher from being affected due to the movement or separation of the liquid detergent dispensing assembly, which facilitates the adding of the liquid detergent.

In some embodiments, as illustrated in FIG. 4 and FIG. 5, the liquid detergent dispensing assembly further includes the pump body 20 and the driving assembly 30. The pump body 20 is mounted within the liquid storage container 10, and has the pump head 21. The pump head 21 is movable relative to the liquid storage container 10 to pump liquid detergent out of the liquid storage container 10. Thus, the liquid detergent is pumped conveniently and quickly, and the volume of the pumped liquid detergent every time is controllable.

In addition, as illustrated in FIG. 2 to FIG. 4, the base 50 further has the accommodation cavity 54. The driving assembly 30 is mounted in accommodation cavity 54, and is configured to drive the pump head 21 to move towards the liquid storage container 10 to press the pump head 21. In this way, the liquid detergent in the liquid storage container 10 is pumped into the washing chamber. Thus, the automatic dispensing of the liquid detergent can be realized.

Further, it is not necessary for the user to manually dispense the liquid detergent into the washing chamber each time before washing the tableware. Thus, it is possible to avoid the manual adding and frequent dispensing of the liquid detergent, which makes the dishwasher more convenient to be used. In addition, it is also possible to avoid the washing effect of the tableware from being affected due to the liquid detergent being forgotten to be dispensed by the user.

In some embodiments of the present disclosure, as illustrated in FIG. 1 to FIG. 4, the liquid storage container 10 is detachably mounted in the mounting chamber 52 to facilitate the replacement of the liquid storage container 10 or the adding of the liquid detergent to the liquid storage container 10. Thus, long-term use of the dispensing device 100 can be ensured.

In some embodiments in which the base 50 includes the base body 501 and the cover body 502, it is ensured that the liquid storage container 10 is fixed in the mounting chamber 52 by exposing or covering the opening 521 of the cover body 502. Thus, it is possible to prevent the normal use of the dishwasher from being affected due to the movement or falling of the liquid storage container 10, and it is beneficial to taking, placing, assembling, and disassembling the liquid storage container 10 to facilitate replacement of the liquid storage container 10 with a new liquid storage container or the adding of the liquid detergent into the liquid storage container 10.

The dispensing device 100 according to an exemplary embodiment of the present disclosure will be described in detail below with reference to the accompanying drawings. It should be understood that the following description is merely exemplary, and should not be understood as a limitation to the present disclosure.

Referring to FIG. 2, FIG. 4, FIG. 5 and FIG. 8, the dispensing device 100 includes a liquid storage container 10, a base 50, a pump body 20, a driving assembly 30, a position detection assembly 70, a control assembly, a seal 60, a powder detergent dispensing assembly 80, and a rinse aid dispensing assembly 81.

The base 50 includes a base body 501 and a cover body 502 hinged to the base body 501. The base 50 is mounted on a door body of a dishwasher. The base 50 has a mounting chamber 52, a communication port 53, and a guide channel 51 extending in a leftward-rightward direction. The communication port 53 is configured to communicate the guide channel 51 with the mounting chamber 52. The mounting chamber 52 has an opening 521. A through opening 522 is formed on a wall of the mounting chamber 52. The driving assembly 30 includes a driving member 31 and a transmission member 32. The driving member 31 includes a driving motor 311 and a connector 312. The connector 312 is an eccentric wheel provided with an engagement protrusion 313. An engagement groove 321 is formed on an upper part of the transmission member 32, and extends in the leftward-rightward direction. The eccentric wheel is configured to connect an output end of the driving motor 311 and the transmission member 32. The transmission member 32 passes through the communication port 53. The seal 60 is configured to seal a gap between the transmission member 32 and an inner peripheral surface of the communication port 53. The liquid storage container 10 is configured to store the liquid detergent therein. The pump body 20 is detachably connected to the liquid storage container 10. The liquid storage container 10 and the pump body 20 are detachably mounted in the mounting chamber 52. The pump body 20 includes a pump head 21 and a reset member. The pump head 21 is provided with a limiting groove 40. A limiting protrusion 41 is disposed on a lower part of the transmission member 32. The transmission member 32 is detachably fitted with the pump head 21. The pump head 21 protrudes into the washing chamber through the through opening 522. The position detection assembly 70 includes a microswitch mounted on the base 50. The control assembly is connected to the microswitch and the driving member 31. The microswitch has a contact 541. A trigger protrusion 322 is disposed at the middle of the transmission member 32, and is located within the accommodation cavity 54. The contact 541 protrudes into the accommodation cavity 54.

Referring to FIG. 4, FIG. 5 and FIG. 8, the transmission member 32 is normally located in an initial position, i.e., a first predetermined position. In response to the dispensing device 100 being started, the eccentric wheel is driven by the driving motor 311 to rotate, and the engagement protrusion 313 moves along the engagement groove 321 to convert the rotation of the eccentric wheel into a reciprocation of the transmission member 32 in an upward-downward direction. In this way, the transmission member 32 can reciprocate between the first predetermined position and a second predetermined position. When the transmission member 32 moves from the first predetermined position to the second predetermined position, the transmission member 32 moves downwards, and abuts against the pump head 21. Further, the limiting protrusion 41 is inserted into the limiting groove 40, and the pump head 21 is driven by the transmission member 32 to move downwards to pump the liquid detergent in the liquid storage container 10 into the washing chamber. When the transmission member 32 moves from the second predetermined position to the first predetermined position, the transmission member 32 is driven by the driving member 31 to move upwards to be reset to the first predetermined position, and the pump head 21 is driven by the reset member to move upwards to reset the pump head 2. The above movement is repeated to pump the liquid detergent in the liquid storage container 10 into the washing chamber of the dishwasher in several times. Further, when the transmission member 32 moves to the first predetermined position, the trigger protrusion 322 is in contact with the contact 541 to trigger the microswitch, and the control assembly counts in response to the microswitch being triggered. As the above movement is repeated, the count value increases. In response to the count value reaching a predetermined threshold, the control assembly controls the driving member 31 to stop operating, and cuts off a power of the driving motor 311 to complete an automatic dispensing of the liquid detergent in the washing process.

A dishwasher according to embodiments of the present disclosure includes the dispensing device 100 for the dishwasher according to the embodiments of the present disclosure. Since the dispensing device 100 according to the embodiments of the present disclosure has the above beneficial technical effects, in the dishwasher according to the embodiments of the present disclosure, by driving the transmission member 32 by the driving member 31 to move towards the liquid storage container 10 along the first straight path to allow the transmission member 32 to drive the pump head 21 to move towards the liquid storage container 10, the liquid detergent in the liquid storage container 10 is pumped into the washing chamber. Thus, an automatic dispensing of the liquid detergent can be realized, which avoids manual adding and frequent dispensing of the liquid detergent by the user. In addition, the dishwasher is more conveniently used, and the transmission member 32 and the pump head 21 can move smoothly and are not prone to failure or cause the leakage of the liquid detergent. Thus, it is convenient to disassemble and assemble, and the maintenance costs can be reduced. The control assembly can control the operation state of the driving member 31 based on the detection of the position detection assembly 70. Thus, it is possible to more accurately control the dispensing volume of the liquid detergent when washing the tableware, and the control is thus convenient.

With the dispensing device 100 according to the embodiments of the present disclosure, by providing the liquid detergent dispensing assembly, the powder detergent dispensing assembly 80, and the rinse aid dispensing assembly 81, the user may select among the liquid detergent, the powder detergent, and the rinse aid to further satisfy more use demands of the user on the dishwasher, which has greater practicability.

Other arrangements and operations of the dispensing device 100 and the dishwasher according to the embodiments of the present disclosure are known to those of ordinary skill in the art, and the description thereof in detail will omitted herein.

In the present disclosure, it should be noted that, unless otherwise clearly specified and limited, terms such as "install", "connect", "couple", and the like should be understood in a broad sense. For example, it may be a fixed connection or a detachable connection or connection as one piece; a mechanical connection or an electrical connection; a direct connection or an indirect connection through an intermediate; or internal communication of two components. For those of ordinary skill in the art, the specific meaning of the above terms in the present disclosure should be understood according to specific circumstances.

In the description of this specification, descriptions with reference to the terms "embodiments", "specific embodiments", "examples", etc., mean that specific features, structure, materials or characteristics described in conjunction with the embodiment or example are included in at least one embodiment or example of the present disclosure. In this specification, the schematic representations of the above terms do not necessarily refer to the same embodiment or example. Moreover, the described specific features, structures, materials or characteristics may be combined in any one or more embodiments or examples in a suitable manner.

Although embodiments of the present disclosure have been illustrated and described, it is conceivable for those of ordinary skilled in the art that various changes, modifications, replacements, and variations can be made to these embodiments without departing from the principles and spirit of the present disclosure. The scope of the present disclosure shall be defined by the claims as appended and their equivalents.

What is claimed is:

1. A dispensing device for a dishwasher, the dispensing device comprising:

a liquid storage container configured to store liquid detergent;

a pump body disposed on the liquid storage container and comprising a pump head configured to translate linearly along a first straight path to pump the liquid detergent from the liquid storage container into a washing chamber of the dishwasher; and a driving assembly comprising:

a driving member comprising a connector configured to rotate about a connector rotation axis and comprising an engagement protrusion radially offset from the connector rotation axis; and a transmission member at least partially disposed within a guide channel oriented along the first straight path, and comprising an engagement groove: extending along a second straight path;

interfacing with the engagement protrusion of the connector; and being configured to translate a rotation of the connector into a linear translation of the transmission member along the first straight path, wherein the transmission member is configured to abut against the pump head to transfer the linear translation of the transmission member along the first straight path to linear translation of the pump head along the first straight path effective to pump the liquid detergent into the washing chamber.

2. The dispensing device according to claim 1, wherein the transmission member is further configured to translate linearly towards the liquid storage container along the first straight path to drive the pump head to move towards the liquid storage container.

3. The dispensing device according to claim 2, wherein:

the transmission member is further configured to translate linearly away from the liquid storage container along the first straight path to reset the driving assembly; and/or the pump body further comprises a reset member configured to drive, in response to the transmission member translating linearly away from the liquid storage container along the first straight path, the pump head to move away from the liquid storage container; and/or one of the pump head and an end of the transmission member has a limiting groove, and the other one of the pump head and the end of the transmission member has a limiting protrusion configured to interface with the limiting groove.

4. The dispensing device according to claim 2, further comprising a base having the guide channel.

5. The dispensing device according to claim 4, wherein:

the base further has a mounting chamber and a communication port configured to communicate the guide channel with the mounting chamber;

the liquid storage container and the pump body are disposed in the mounting chamber; and the transmission member passes through the communication port.

6. The dispensing device according to claim 5, further comprising a seal configured to seal a gap between the transmission member and a peripheral surface of the communication port.

7. The dispensing device according to claim 2, wherein the driving member further comprises a driving motor comprising an output end, wherein the connector is coupled with the output end of the driving motor.

8. The dispensing device for the dishwasher according to claim 1, wherein every two of a rotation axis of the eccentric wheel, the first straight path, and the second straight path are perpendicular to one another.

9. The dispensing device according to claim 2, wherein the transmission member is not attached to the pump head.

10. The dispensing device according to claim 1, wherein the pump head is further configured to directly dispense the liquid detergent into the washing chamber.

11. The dispensing device according to claim 10, wherein the pump head has a dispensing port configured to be in direct communication with the washing chamber.

12. The dispensing device according to claim 10, further comprising a base, wherein the pump body is fixedly or detachably arranged on the base.

13. The dispensing device according to claim 12, wherein:

the base forms a mounting chamber having a through opening; and the pump head protrudes into the washing chamber through the through opening to facilitate delivery of the liquid detergent to the washing chamber.

14. The dispensing device according to claim 13, wherein:

the pump body and the liquid storage container are integrally formed and disposed in the mounting chamber; or the liquid storage container is formed separately from the pump body and configured to be connected with the pump body when the liquid storage container is mounted on the base.

15. The dispensing device according to claim 13, wherein the base comprises:

a base body forming the mounting chamber, the mounting chamber having an opening; and a cover body configured to expose or cover the opening.

16. The dispensing device according to claim 1, wherein the pump body is connected to the liquid storage container.

17. The dispensing device for the dishwasher according to claim 15, wherein the through opening is formed by the cover body.

18. A dishwasher comprising the dispensing device according to claim 1.

* * * * *